United States Patent [19]

Peterson et al.

[11] 4,157,051

[45] Jun. 5, 1979

[54] INDICATING ORGAN STOP TABLET

[76] Inventors: Richard H. Peterson, 11748 Walnut Ridge Dr., Palos Park, Ill. 60464; Richard W. Jensen, 583 Fay Ave., Elmhurst, Ill. 60126

[21] Appl. No.: 810,136

[22] Filed: Jun. 27, 1977

[51] Int. Cl.[2] ..... G10B 3/10

[52] U.S. Cl. ..... 84/343; 84/369; 84/1.17

[58] Field of Search ..... 84/343, 344, 369, 370, 84/85, 1.17, DIG. 7, DIG. 22, 464, 478, 477 R

[56] References Cited

U.S. PATENT DOCUMENTS

| | | | |
|---|---|---|---|
| 3,460,426 | 8/1969 | Jensen | 84/478 |
| 4,023,457 | 5/1977 | Kirkwood | 84/343 |

*Primary Examiner*—L. T. Hix

*Assistant Examiner*—S. D. Schreyer

*Attorney, Agent, or Firm*—Spencer E. Olson

[57] ABSTRACT

A stop tablet control system for an organ in which the "on" condition of selected stops is indicated by an illuminated light-emitting diode (L.E.D.) mounted in each stop tablet. The stop tablets are pivotally supported on a tablet rail and spring-biased to assume a neutral position from which they can be momentarily moved up or down against the action of the spring. When a tablet is momentarily pushed down from the neutral position a switch is closed to actuate circuitry which turns on the associated stop and energizes the L.E.D., and when the tablet is momentarily pushed up from the neutral position the associated stop is turned "off" and the L.E.D. extinguished. The system includes control circuitry for providing in a combination stop action mode an indication of what stops are playing.

6 Claims, 5 Drawing Figures

INDICATING ORGAN STOP TABLET

BACKGROUND OF THE INVENTION

This invention relates to organ systems, and more particularly to a stop tablet control system for an organ for providing convenient visual indication of what stops are being played.

Over the many years of organ development, a wide variety of systems for controlling organ stops have been devised, perhaps the earliest of which was a form of draw knob which, in the case of a pipe organ, required the exertion of considerable energy to accomplish the mechanical result necessary to achieve the desired stop effect. Such draw knobs have in more recent times been electrified and provided with switches which are actuated by movement of the knobs to activate electrical or pneumatic systems for accomplishing the required mechanical work involved in setting the stops. Another system now in common use is the so-called tablet control, which consists of a multiplicity of stop tablets pivotally supported above the keyboard of the organ and typically arranged to toggle between an up "off" position and an "on" down position. Another type of system is the tilting tablet, used to some degree in pipe organs, and quite commonly on spinet electronic organs, which consists of a small tilting tablet, pivoted in the middle, which when the upper part is pushed turns on the stop and when the lower part is pushed the stop is turned off.

In all of these systems the "on" and "off" condition of each stop is visually indicated by the mechanical position of the draw knob or stop tablet. Although such systems have long been in use, indicating that their performance is generally satisfactory, they do have limitations, particularly when used with so-called "combination actions" in which many stops are changed en masse. With combination actions, of which several types are known, pushing a single button called a piston automatically changes the registration of all of the stops (which sometimes number 100 or more) en masse, or at least all of the stops in a particular division of the organ. Several preset combinations are stored in some form of temporary memory so that the organist can alter which stops are played in response to actuation of a given piston as requirements change from time to time. Sometimes during a concert, the organist will find it desirable to change the combination between selections so that a given piston will give a particular tonal effect in one case and a different tonal effect, appropriate to another selection, in the other case. Usually, however, the pistons in a church organ, of which typically there are six, ten or sixteen pistons per keyboard, would be set up in their most generally used combinations, but adapted to be changed from time to time.

A drawback of combination actions, which has largely limited their use to large, expensive organ systems, is their cost. Even the simple hard-wired combination system, in which the stops that are actuated by a given piston are pre-wired at the factory, and thus not subject to variation, require physical movement of several tablets, which is difficult to accomplish silently. For example, if the toggle action of the tablets is designed to have a "positive" feel when operated manually, a multiplicity of tablets will offer considerable spring resistance that must be overcome by the motor mechanism that actuates the tablets, thus generating a certain amount of undesirable noise as they all toggle from one position to another. Moreover, a large amount of power is required to operate combination actions of the kinds in current use. If, for example, the stop tablets, in the combination action mode, are actuated by respective magnets, which may number as many as 200, and it is desired to move all 200 tablets from their "on" to their "off" position at the same time, a relatively large amount of power is required which, in turn, necessitates the provision of a large and expensive power supply. Because of these costs and complications, low priced electronic organs are not equipped with combination actions. Some available organs have a system of preset combinations wherein pushing a given piston button disables all of the conventional stop controls and substitutes some factory pre-wired combination. Such organs normally have an indicator lamp installed somewhere on the organ which when illuminated tells the organist that he is not using the manual stops but is instead using a factory preset combination. Unless the organist is totally familiar with the organ, he has no way of knowing which stops are on when a particular pre-wired combination is selected. There is nothing to tell the organist that stops are being played, thereby making it difficult to manually "tailor" the combination should he decide that the stops being played are less than satisfactory for the selection he is playing. Thus, it is evident that a non-indicating system, particularly in the case of combination actions, is very limited and leaves much to be desired.

Although it is known to employ illuminated switches on electronic organs to indicate when a stop or stops are actuated, such systems suffered from the mechanical difficulties discussed above and lacked aesthetic appeal. For example, in the early 1900's the Estey Company of Brattleboro, Vermont, manufactured what was known as the "cash register" organ which had an array of buttons having lamps therein that would be selectively illuminated upon momentary depression of a respective button to indicate that a given stop had been actuated. A more recent application of the general concept of utilizing an energized lamp to indicate the actuation of a stop control device is in certain organ models manufactured by the Rodgers Organ Company in which draw knobs used for stop control have lamps mounted therein which are energized in response to operation of the draw knob of the "on" position and are extinguished when the draw knob is returned to its normal unoperated position.

It is a primary object of the present invention to provide a true indicating combination action for an organ which overcomes the above-described problems of present systems. Another object of the invention is to provide an indicating combination action that is silent in operation, is easy to manufacture and adjust, requires a minimum of power for its operation, and gives the organ a certain visual appeal.

SUMMARY OF THE INVENTION

Briefly, the stop tablet control system according to the invention includes a multiplicity of stop tablets pivotally supported on a tablet rail and springbiased to assume a neutral position from which they can be momentarily moved up or down against the action of the spring, and an electrical latching circuit adapted to be latched into one or the other of two stable states by a pulse produced upon momentary movement of the stop tablet. When a tablet is momentarily pushed downwardly from the neutral position the circuit is latched into a first state and energizes a light emitting diode mounted on the operated stop tablet and also turns on the associated stop. When the tablet is momentarily moved upwardly from the neutral position, the associated stop is turned off and the light emitting diode is extinguished. Each stop tablet has an associated latching circuit whereby one can tell at a glance from the illuminated light emitting diodes which of the stops are in the "on" condition.

The system according to the invention further includes a plurality of combination pistons, each having circuit means associated therewith for toggling a preselected plurality of latching circuits to their "on" states for as long as the piston is held, thereby to energize the light emitting diodes on the preselected stop tablets, and circuit means operative when a piston is momentarily depressed to toggle all of the non-selected stops to their "off" condition.

BRIEF DESCRIPTION OF THE DRAWINGS

Other objects, features and advantages of the invention will become apparent, and its construction and operation better understood, from the following detailed description taken in conjunction with the accompanying drawings, in which.

DESCRIPTION OF THE PREFERRED EMBODIMENT

Figure 2:
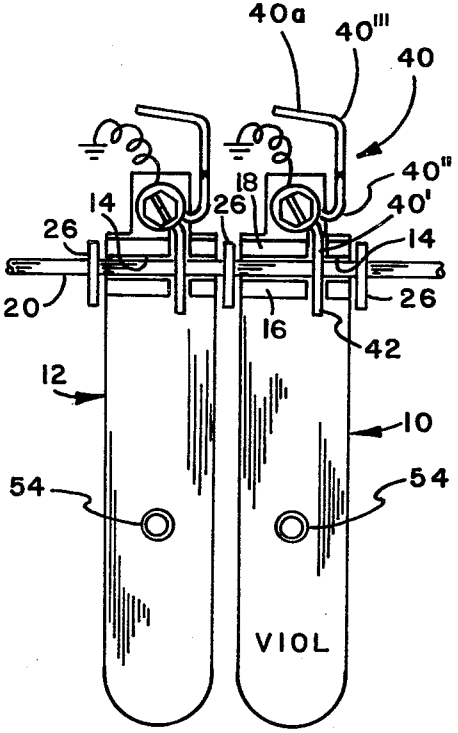
FIG. 2 is a top plan view of two stop tablets of the type shown in FIG. 1.
Figure 1:
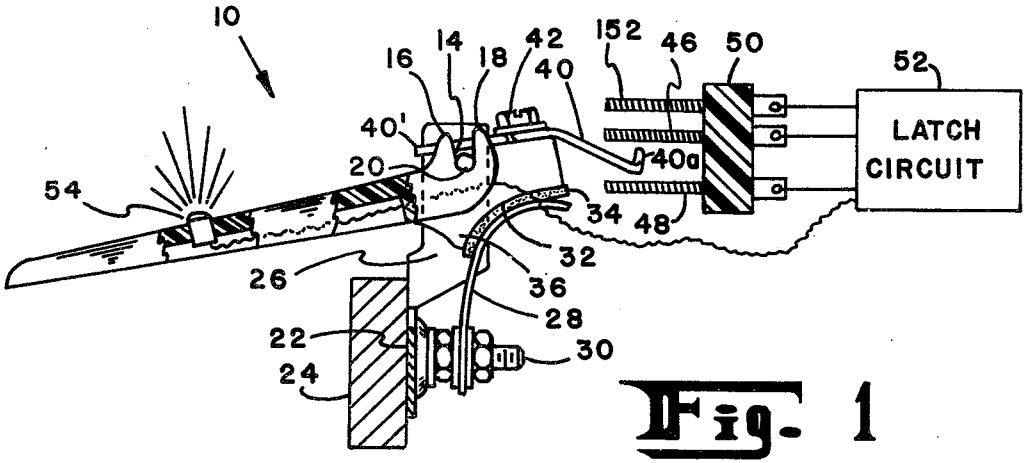
FIG. 1 is an elevation view, partly in section, of a stop tablet mechanism according to the invention.

Referring to FIGS. 1 and 2, the present stop tablet control system includes a multiplicity of stop tablets or more or less conventional design, one of which is shown in elevation at 10 in FIG. 1, and two of which are shown at 10 and 12 in FIG. 2. The tablets, which are shown approximately full size, are typically molded of a suitable plastic material, and have a cross-section as indicated in FIG. 1. The illustrated tablet, which has been used on Gulbransen organs for several years, has a transverse groove 14 therein defined by a pair of upstanding lips 16 and 18 of a depth of about one-quarter inch, for receiving a tablet rail 20 which, in turn, is supported on a stop tab mounting bracket 32 secured to the cabinet of the organ, as diagrammatically illustrated at 24. The mounting bracket has a multiplicity of flanges 26 disposed perpendicularly to the axis of the rail 20 and spaced apart a distance so as to receive a stop tablet between adjacent brackets as shown in FIG. 2. The mounting bracket 22 and the rod 20 are sufficiently flexible to permit its being mounted in a horseshoe configuration, as is typical on many organ consoles. The stop tablet 10 is urged upwardly (so that rod 20 engages the bottom of the groove 14) by a flat spring 28, preferably formed of phosphor-bronze, secured at its lower end to the mounting bracket 22 by a fastener, such as the illustrated stud 30. The spring, which may have a thickness of the order of 0.020 inch and a width of about one-half inch, is curved at its upper end to conform to the curved under-side 32 of the right-hand 32 of the right-hand end of the tablet, as viewed in FIG. 1. A thin strip of felt 34 is adhesively joined to the upper surface of the spring over the region of contact with the stop tablet to ensure smoothness and quietness of relative movement between the spring and tablet as the tablet is actuated. The spring 28 is designed to urge the bottom of the groove 14 against the rod 20 and to maintain the tablet in the neutral position shown in FIG. 1. When the left-hand end of the tab is depressed, a protuberance 36 at the lower extremity of the curved surface 32 urges the spring 28 to the right, causing it to bend at a point somewhat above the fastening means 30; when pressure on the tab is released, the spring returns the tablet to its neutral position. When the tablet is moved upwardly, the upper extremity of the curved surface 32 tends to bend the spring to have a sharper radius of curvature and, again, when the upward pressure is released the spring returns the tablet to its neutral position. The spring 28 is sufficiently stiff to give a "positive" feel to the tablet operation, and to return and maintain the tablet in its pre-determined neutral position with relative firmness. Thus, if all of the tablets and springs are manufactured to the same tolerance, which is relatively easy to accomplish, the tablets all assume the same neutral position and give the stop tablet assembly an even and neat appearance.

As best seen in FIG. 2, the upper surface of that portion of the tablet that has the curved underside 32 is formed to receive a contact wire 40, which is secured to the tablet by a screw 42. The wire is shaped to have a U-shaped bend under the head of the screw and to extend rearwardly at 40' and to be engaged in a longitudinal groove 42 formed in lips 16 and 18, and is bent at right angles at points 40'' and 40''' to provide a portion **40*a* disposed substantially parallel to the rod 20. The section 40' of the wire passes with clearance over the rod 20, and each of the wires 40 is grounded, as shown, for reasons that will become evident from the description of the circuit of FIG. 4. When the tablet is depressed the section 40*a* of the wire moves upwardly, and when the tab is moved up the section 40*a* of the wire moves downwardly. The shaped wires 40 constitute movable contactors which, as shown in FIG. 1, engage a first fixed contact 46 when the tablet is depressed and engage a second fixed contact 48 when the tablet is moved upwardly from its neutral position. Typically, the contacts 46 and 48 take the form of small coil springs supported on an insulative panel diagrammatically illustrated at 50, and in the present system are connected to an associated latch circuit 52**.

In a manner to be more fully described in connection with FIG. 4, when the tablet is depressed the latch circuit is operative to turn on the associated stop and also to energize a light emitting diode (L.E.D.) 54 mounted in an opening through the tablet so as to be visible from the upper side thereof. The particular placement of the L.E.D. on the tablet is a matter of choice, but the illustrated location near the free end of the tablet, between the conventional printed identification of the stop tablet, has been found to be aesthetically pleasing as well as readily visible to the organist.

Figure 4:
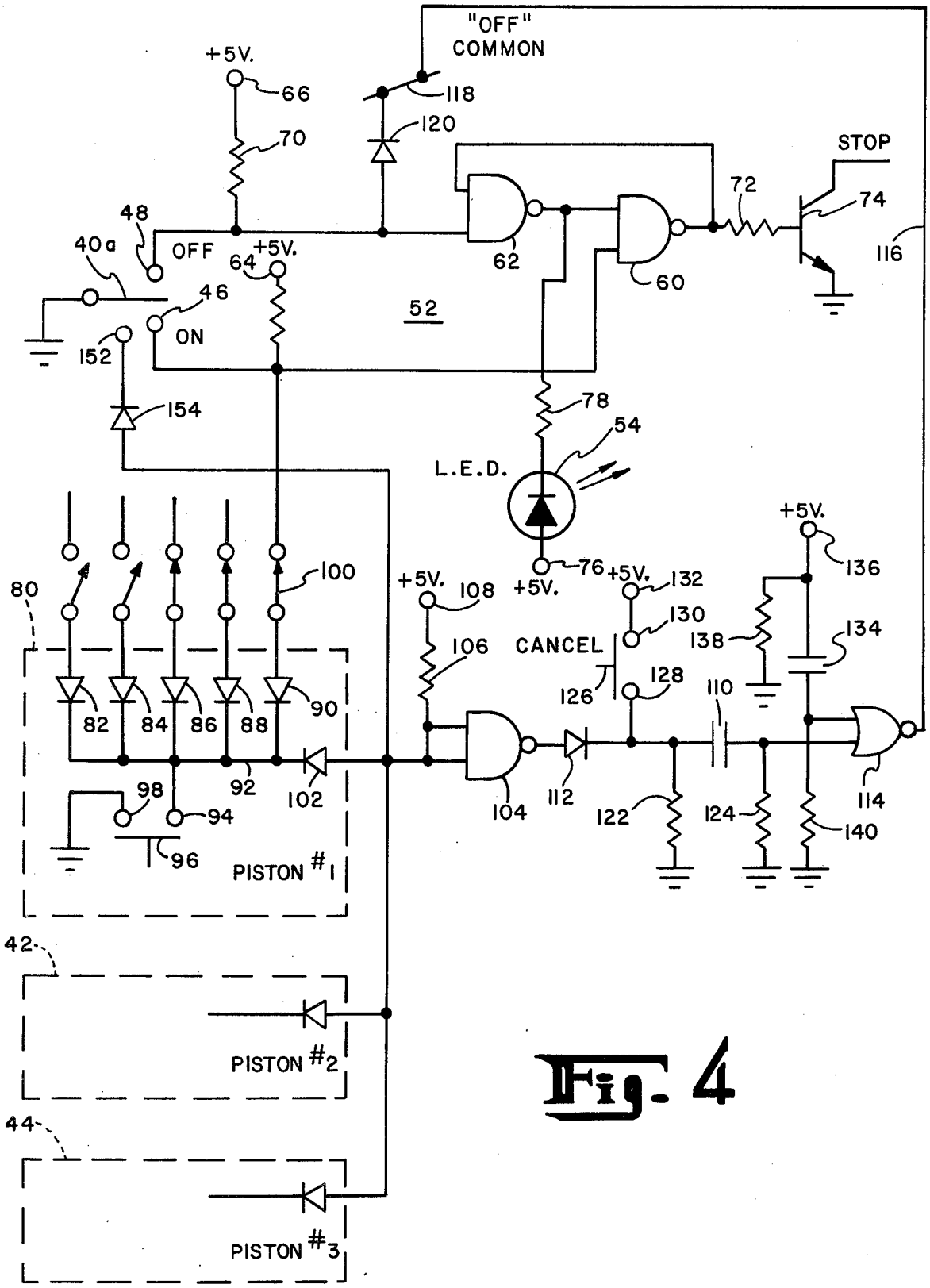
FIG. 4 is a circuit diagram of latching circuitry useful with the illustrated stop tablet mechanism.

Turning now to FIG. 4, each of the stop tablets of the organ system has an associated latch circuit 52 wherein the portion **40*a* of the wire on the stop tablet is the movable contact of a single-pole double-throw switch of the momentary contact type. As has been noted earlier, when the stop tablet is pushed downwardly, the movable contact 40*a* momentarily engages the "on" contact 46, and when the tablet is pushed up from its neutral position it momentarily engages contact 48. Each of contacts 46 and 48 is connected to one input of a NAND gate 60 and 62, respectively, each of which may be one section of the commercially available integrated circuit SN7400. Each of these input terminals are returned to a source of positive potential, typically having a value of 5 volts, represented by terminals 64 and 66, respectively, through pull up resistors 68 and 70, respectively. The output of NAND gate 62 is connected to the other input of NAND gate 60, and the output of NAND gate 60 is connected to the other input of NAND gate 62. The two NAND gates thus comprise a DC flip-flop circuit which will remain in which ever stable condition into which it is set. The output terminal of NAND gate 60 is connected through a resistor 72 to the base electrode of a transistor 74, the emitter electrode of which is connected to ground. When the base electrode of transistor 74** is made positive, the collector electrode, which is connected to the organ stop with which the latch circuit is associated, is connected to ground through the collector-emitter junction of the transistor, thus actuating the associated organ stop. It is to be understood that the described circuit for actuating the stop is by way of example only, and that a different arrangement would be used in an organ system in which the stops are actuated by application of a positive potential rather than by connection to ground potential.

The light emitting diode 54, which is physically mounted on the stop tablet 10, has one of its terminals connected to a source of positive potential, typically having a value of 5 volts, represented by terminal 76, and its other terminal is connected through a resistor 78 to the output terminal of NAND gate 62. Thus, whenever the stop switch contact **40*a* is moved into contact with the "on" terminal 46, the output terminal of NAND gate 62 will be at substantially ground potential, thereby causing the light emitting diode 54 to become illuminated, with its current limited by resistor 78** to give the desired brightness.

When the contact **40*a* is caused to momentarily engage the "off" contact 48, the described latch circuit is toggled to the condition where the potential at the output terminal of gate 62 is high, thereby extinguishing the light emitting diode, and the potential at the output of NAND gate 60 is low, thereby to open the collector-emitter junction of transistor 74** and causing the associated stop to be turned off. If the organ system does not have a combination action, the circuitry described thus far, one latch circuit for each stop tablet, is all that is required to provide visual indication of which stops are being played.

The described latch circuit is readily adapted for use with combination actions, a simple diode matrix type of which is shown by way of example in FIG. 4, to provide visual indication of the stops being played. The combination action typically incorporates a plurality of pistons, the circuitry for one of which is contained in the dotted line enclosure 80, consisting of a plurality of diodes 82, 84, 86, 88, and 90 through which the "on" terminal of the latching circuit associated with the stop tablets of a given division of the organ (such as solo, accompaniment or pedal) are each connected to a conductor 92 which, in turn, is connected to one terminal 94 of a piston switch 96, and other terminal 98 of which is connected to ground potential. In the drawing, the "on" terminal 46 of latching circuit 52 is connected through diode 90 to piston switch terminal 94. Preferably the connection from terminal 46 additionally includes a single-pole single-throw switch 100 in series with the diode to enable the organist to preselect, in advance, simply by closing or opening certain of the switches, the registration that will result when the piston is depressed. When the piston 96, typically a small thumb-operated button, is momentarily depressed, contacts 94 and 98 are momentarily short-circuited and connect conductor 92 to ground potential. Conductor 92 is connected through a diode 102 to one input of an inverter 104 whose input potential is held high by a pull-up resistor 106 connected from both inputs of the inverter to a source of positive potential, typically having a value of 5 volts, represented by terminal 108. When the potential at the input of inverter 104 is lowered by closure of switch 96, the potential at its output terminal will go high and charge a capacitor 110 through a diode 112, and thereby apply current to one input of a NOR gate 114 for a brief period. Since both inputs of the NOR gate are normally held low, application of current to one of its inputs produces a pulse at the output terminal having a time constant determined by the value of capacitor 110. This pulse is applied via conductor 116 and an "off" common bus 118 and a diode 120 to one input of NAND gate 62, causing the flip-flop to be set to the "off" condition. It will be understood that the "off" common bus 118 will be connected to the same point in the latching circuits associated with the other stops controlled by piston 96 through respective diodes. Thus, any stop connected to conductor 92 will automatically be turned off when the piston 96 is initially depressed.

The circuit operates as just-described to set all of the stops associated with piston No. 1 to their "off" condition, but is also effective, as follows, to turn "on" those stops selected by switches 100. The pulse produced at the "off" common bus 118 upon initial depression of piston 96 is relatively short compared to the time that the organist will hold the thumb operated piston depressed; since it is virtually impossible to hold the piston (or a stop tablet) in its depressed position for less than fifty or one hundred milliseconds, a pulse of a few milliseconds duration will with certainty be completed before the piston is released. Thus, even as the short pulse produced by the initial short-circuiting of contacts 94 and 98 is trying to toggle the flip-flop to the "off" condition, the "on" input of NAND gate 60 is being held at ground potential through switch 100, diode 90, conductor 92 and the piston switch 96. In other words, the command telling the flip-flop to toggle to the "on" condition is retained long after the momentary pulse that would otherwise toggle the flip-flop to the "off" condition has passed, thus assuring that the latch is toggled to its "on" condition. Resistors 122 and 124 serve to reset the capacitor 110 so that in the event another piston is operated shortly after piston No. 1 has been operated, the circuit will again function to supply another "off" pulse to the common bus 118.

The circuit also includes a "cancel" piston 126 which has contacts 128 and 130 respectively connected to one terminal of capacitor 110 and to a source of positive potential, typically 5 volts, represented by terminal 132. When contacts 128 and 130 are momentarily shorted together by depression of the cancel piston to apply a positive potential to capacitor 110, a short pulse is produced at the output of NOR gate 114 which toggles the flip-flop to its "off" condition. It will be noted that the "cancel" piston does not affect any aspect of the system which would tend to toggle the latch circuit to the "on"

condition and accordingly simply cancels any stops that were previously set to the "on" condition.

In order to guarantee that all of the stops are set to the "off" condition when the organ is initially turned on, one of the inputs of NOR gate 114 is connected through a capacitor 134 to a source of positive potential, typically having a value of 5 volts, represented by terminal 136, it being understood that there will be no potential at terminal 136 when the organ is turned off. A pull-down resistor 138 is connected from one terminal of capacitor 134 to ground, and a reset resistor 140 is connected from the other terminal of the capacitor to ground. When the organ power is initially turned on the potential from source 136 charges capacitor 134 to produce a momentary pulse at the output of gate 114 which is applied to the "off" common bus 118, thereby to turn all of the stops "off". Although not essential, this is a desirable feature because without it there is a possibility that some stops would be "on" and others "off", in a random manner, every time the organ is turned on.

As has been noted earlier, an organ may have any number of pistons, ranging from perhaps a minimum of four up to perhaps 100 or more in the case of large theater organs, divided up into divisional pistons and general pistons. That the system of FIG. 4 may employ a plurality of pistons is indicated by the dotted enclosures 142 and 144 which would each contain circuitry for pistons #2 and #3 similar to that described in connection with piston circuit 80. It is significant to note, however, that regardless of the number of pistons provided in the organ it is necessary to have but one control circuit (i.e., the circuit including inverter 104 and NOR gate 114) to control all of the piston circuits. Thus, since each piston would require a relatively small number of inexpensive diodes, and it is not necessary that the control circuit be duplicated for each piston, it will be evident that a rather comprehensive combination action can be realized at relatively low cost.

Although the invention has been described in association with a diode matrix type of combination action, the inventive concepts and principles are equally applicable to other known types of combination actions. For example, a full capture type combination action, wherein by manually setting selected tablets to the desired registration and then holding the associated piston as a set button is pushed, one can capture that combination on a given piston for later recall whenever that piston is pushed, can be used. Accordingly, it is to be understood that the invention is not limited to the specific circuitry that has been illustrated and described.

An important advantage of the overall system described herein is that there has not been a major change from the familiar appearance of organs: the stop tablets look the same as they do in conventional organs and the action taken by the organist is the same as with conventional organs. That is, when it is desired to turn a given stop on, he reaches up and depresses the appropriate stop tablet, and when he wants to turn off a given stop he pushes the tablet upwardly in the same way as he is accustomed. Organists who have used the described system have remarked that while the illuminated light emitting diodes give the organ a uniquely different appearance than a conventional organ, none has had to ask how the stop tablets are to be used. The aesthetic appeal of the array of stop tablets may be enhanced by using light emitting diodes of distinctive colors to indicate different classes of stops, much as different colored tablets are currently used for this purpose. For example, red L.E.D.'s might be used to indicate reeds, green ones to indicate flue stops, and amber ones to indicate strings, these three colors now being commercially available.

Figure 3A:
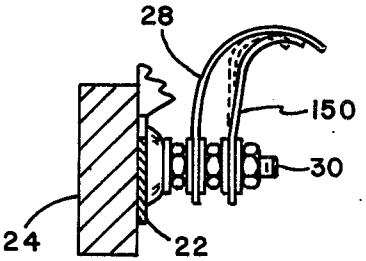
FIGS. 3 and 3A are fragmentary elevation views illustrating the construction and function of a modification of the stop tablet mechanism of FIG. 1.
Figure 3:
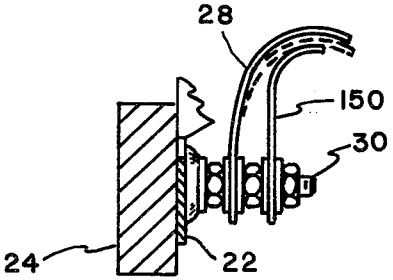

The described construction of the stop tablet mechanism and the described circuit can with minor modification provide another desirable feature to an organ having a combination action. It is sometimes desirable when playing a given registration of stops to select another stop, for example, a single melody stop, and cancel any other stops in the division that were previously sounding. Referring to FIG. 3, this function may be added to the present system by adding an additional spring 150 to each stop tablet assembly which is spaced from the spring 28 and is somewhat shorter than spring 28. The two springs have such relative lengths that when the tablet is pushed to its "on" position the bent spring 28, shown in dotted line, will come in contact with the upper curved end of spring 150, the latter thus offering resistance to further downward movement of the stop tablet. The modulus of spring 150 is such that upon further depression of the stop tablet, i.e., beyond the point of increased resistance provided by spring 150, the upper end of spring 150 is deflected, as shown in FIG. 3A, allowing further downward movement of the tablet. When in its fully depressed position, the wire contactor **40*a* on the tablet contacts an additional contact 152 (while at the same time also engaging contact 46) supported on the panel 50 (FIG. 1) and connected to the latch circuitry 52. As seen in FIG. 4, the additional contact 152 is connected through a diode 154 to the input of inverter 104. Consequently, when the stop tablet is depressed to the point where contact 40*a* engages both of contacts 46 and 152, the input to inverter 104 is grounded causing its output terminal to go high and to produce a cancelling pulse at the output of NOR gate 114 to turn off any other stops in the division that were previously sounding. Then, as the stop tablet is released, first breaking contact between contactor 40*a* and contact 152, while still maintaining contact between contactor 40*a* and contact 46**, the latch circuit associated with that stop tablet will toggle the flip-flop to the "on" condition and turn on the single stop associated with the tablet. This feature would usually be employed only on the solo divisional pistons, and its utility lies in the fact that when playing a given registration it is possible to substitute a single melody stop and to cancel any other stops in the division that were previously playing.

We claim:

1. An indicating stop tablet system for an organ having a plurality of stops comprising, in combination:

an array of a like plurality of pivotally mounted stop tablets each of which is spring-biased to be returned to a neutral position following either upward or downward movement of the tablet, each of said tablets having a light emitting diode mounted thereon, and each having an electrical contactor secured thereto to be movable with upward and downward movement of the tablet, first circuit means associated with each of said stop tablets including first and second stationary contacts arranged to be engaged by said contactor in response to downward and upward movement, respectively, of said tablet and a latching circuit connected to said stationary contacts and operative to be latched into a first of two stable states in response to momentary engagement of said contactor with one of said stationary contacts and to be latched into the second of said two stable states in response to momentary engagement of said contactor with the other of said stationary contacts, said first circuit means being operative in response to said latching circuit being latched in said first stable state to turn on the organ stop associated with an operated stop tablet and to energize the light emitting diode mounted on the operated stop tablet, and operative in response to said latching circuit being latched in said second stable state to turn off the organ stop associated with an operated tablet and to de-energize and thereby extinguish the light emitting diode mounted on the operated stop tablet, a combination piston operative between an "off" and an "on" position, second circuit means associated with said piston connected to a preselected plurality of said first circuit means and operative in response to said piston being held in its "on" position to toggle the latching circuits thereof to their first stable state, pulse generating means operative in response to initial actuation of said piston to its "on" position for generating a pulse of shorter duration than the time a piston is normally held in its "on" position, and means for applying said pulse to the said first circuit means associated with all of said plurality of stop tablets for toggling the latching circuits associated with all of the non-selected stops to their second stable state.

2. The system according to claim 1, wherein said pulse generating means comprises a capacitor, means operative in response to initial actuation of said piston to its "on" position to apply a charging current to said capacitor, and a gate circuit connected to said capacitor and operative to produce a pulse having a duration proportional to the capitance of said capacitor.

3. The system according to claim 1, wherein said first and second stationary contacts are so disposed relative to said movable contactor that movement of the stop tablet downward a predetermined distance from its neutral position causes said contactor to contact said first stationary contact and said latching circuit to be latched in said first stable position and movement of the stop tablet upward a predetermined distance from its neutral position causes said contactor to engage said second stationary contact and said latching circuit to be latched in said second stable state, and wherein said system further comprises a third stationary contact disposed relative to said movable contactor to be engaged thereby upon downward movement of the stop tablet a distance greater than said predetermined distance, and means connecting said third stationary contact to said pulse generating means, said pulse generating means being operative when said stop tablet is moved downward said greater distance to generate a pulse for setting all the other latching circuits to said second stable state to thereby turn off all the stops other than the operated stop.

4. The system according to claim 3, wherein said stop tablet is biased to its neutral position by a first vertically oriented curved flat spring engaging a curved surface on the underside of the tablet, and wherein said system further comprises a second curved flat spring disposed substantially parallel to said first spring and dimensioned to engage said first spring when the stop tablet is moved downward said predetermined distance from its neutral position to thereby resist further downward movement of the stop tablet and to be deflected upon said greater downward movement of the stop tablet.

5. An indicating stop tablet system for an organ having a plurality of stops comprising, in combination:

an array of a like plurality of pivotally mounted stop tablets each of which is spring-biased to be returned to a neutral position following either upward or downward movement of the tablet, each of said tablets having a light emitting diode mounted thereon, and each having an electrical contactor secured thereto to be movable with upward and downward movement of the tablet, first circuit means associated with each of said stop tablets including first and second stationary contacts arranged to be engaged by said contactor in response to downward and upward movement, respectively, of said tablet and a latching circuit connected to said stationary contacts and operative to be latched into a first of two stable states in response to momentary engagement of said contactor with one of said stationary contacts and to be latched into the second of said two stable states in response to momentary engagement of said contactor with the other of said stationary contacts, said first and second stationary contacts being so disposed relative to said movable contactor that movement of the stop tablet downward a predetermined distance from its neutral position causes said contactor to contact said first stationary contact and said latching circuit to be latched in said first stable position and movement of the stop tablet upward a predetermined distance from its neutral position causes said contactor to engage said second stationary contact and said latching circuit to be latched in said second stable state, said first circuit means being operative in response to said latching circuit being latched in said first stable state to turn on the organ stop associated with an operated stop tablet and to energize the light emitting diode mounted on the operated stop tablet, and operative in response to said latching circuit being latched in said second stable state to turn off the organ stop associated with an operated tablet and to de-energize and thereby extinguish the light emitting diode mounted on the operated stop tablet, a third stationary contact disposed relative to said movable contactor to be engaged thereby upon downard movement of the stop tablet a distance greater than said predetermined distance, pulse generating means, and means connecting said third stationary contact to said pulse generating means, said pulse generating means being operative when said stop tablet is moved downward said greater distance to generate a pulse for setting all the other latching circuits to said second stable state to thereby turn off all the stops other than the operated stop.

6. The system according to claim 5, wherein said stop tablet is biased to its neutral position by a first vertically oriented curved flat spring engaging a curved surface on the underside of the tablet, and wherein said apparatus further comprises a second curved flat spring disposed substantially parallel to said first spring and dimensioned to engage said first spring when the stop tablet is moved downward said predetermined distance from its neutral position to thereby resist further downward movement of the stop tablet and to be deflected upon said greater downward movement of the stop tablet.

* * * * *